US006704953B2

(12) United States Patent
Fishman

(10) Patent No.: US 6,704,953 B2
(45) Date of Patent: Mar. 16, 2004

(54) COMBINATION SLEEPING BAG AND MAT FOR INFANTS AND CHILDREN

(76) Inventor: Zelma Lee Fishman, 1820 Donna St., Los Osos, CA (US) 93402

( * ) Notice: Subject to any disclaimer, the term of this patent is extended or adjusted under 35 U.S.C. 154(b) by 24 days.

(21) Appl. No.: 10/163,960

(22) Filed: Jun. 5, 2002

(65) Prior Publication Data

US 2003/0226205 A1 Dec. 11, 2003

(51) Int. Cl.[7] ..... A47G 9/08
(52) U.S. Cl. ..... 5/413 R; 5/655; 5/417
(58) Field of Search ..... 5/413 R, 413 AM, 5/655, 417, 420; 2/69.5

(56) References Cited

U.S. PATENT DOCUMENTS

| | | | | | |
|---|---|---|---|---|---|
| 2,183,418 | A | | 12/1939 | Williams | 5/334 |
| 3,042,939 | A | | 7/1962 | Schoellkopf, Jr. et al. | 5/343 |
| 3,510,889 | A | * | 5/1970 | Peterson | 5/413 R |
| 3,633,227 | A | * | 1/1972 | Tegeler | 5/413 R |
| 5,005,235 | A | * | 4/1991 | Huang | 5/413 R |
| 5,048,975 | A | | 9/1991 | Holbrook | 383/4 |
| 5,179,741 | A | | 1/1993 | Book | 5/417 |
| 5,404,600 | A | * | 4/1995 | DeMars | 5/413 R |
| D401,736 | S | | 12/1998 | Shaw | D2/719 |

* cited by examiner

*Primary Examiner*—Teri Pham Luu
*Assistant Examiner*—Fredrick Conley
(74) *Attorney, Agent, or Firm*—Coudert Brothers LLP

(57) ABSTRACT

A device is provided to serve a dual purpose of a sleeping bag and sleeping or resting mat for users, e.g., infants and small children, that is easily transportable to an from day care centers or other places while the users are away from their home. The device includes a main body having a front, a back, two sides, a head end, a bottom end, a head section, a body section, and a pocket. The pocket is attached to the sides of the head section and has a slit extending laterally from side to side to receive the main body after it has been rolled up. The sleeping bag in this form is compact and ready for being transported or stored. The body section of the main body has mating zipper halves attached to each sides of the body section to permit parallel zippers to be engaged when the bottom end is adjacent the lateral slit in the pocket. This permits the caregiver to place a child on the front of the bag, bring the bottom end up over the child, and engage each of the parallel zippers without disturbing the child.

17 Claims, 4 Drawing Sheets

COMBINATION SLEEPING BAG AND MAT FOR INFANTS AND CHILDREN

FIELD OF INVENTION

The present invention relates to a combination sleeping bag and mat adapted for the needs of the user, e.g., infants and children. More particularly, the present invention can easily be rolled up to form a convenient shoulder bag.

BACKGROUND OF THE INVENTION

The conventional sleeping bags have a slide fastener or zipper that closes the bottom end and one side of the main body of the bag; see U.S. Pat. No. 3,042,039, column 3, lines 19–22 and FIGS. 1–3. Similarly, multiple zippers have been used to close the bottom end and both sides of the sleeping bag; see U.S. Pat. No. 3,510,889. In the latter sleeping bag, the user is required to fasten the bottom end by pulling on the bottom end zipper's runner and at least the runner on the zipper on one side of the sleeping bag. In the former, the runner of the zipper must be pulled from the bottom end and up the side of the bag. In each of the conventional sleeping bags, an infant or small child becomes disturbed during the fastening and unfastening of the bottom end and sides of the sleeping bag. Additionally, while infants and children can use conventional sleeping bags, such bags are much too large to be rolled into a compact bag easily carried by a child.

In recent years, there are an increasing number of infants and children that are being dropped off by their parents or other caregivers to day care centers. These children are often dropped off early in the morning and not picked up until late in the day. This requires the parents or caregiver to provide suitable mats so that these children have a suitable bed for naps. In addition, an increasing number of children are being dropped off by one of the parents of a divorce or separated couple to the residence of other parent. Such children are much more comfortable if they are able to sleep in familiar bedding.

Accordingly, there is a need for a combination sleeping bag and sleeping mat that rolls into a small, compact bag that may be carried by a child and one that can be accessed without disturbing an infant or child. The sleeping bag becomes that child's familiar bedding and is used for many years.

SUMMARY OF THE INVENTION

The device of the present invention overcomes the problems faced by those individuals requiring a combination sleeping bag for an infant or child that can be opened and closed without awakening the user and a sleeping mat than can be folded into a compact shoulder bag.

One embodiment of the present invention comprises a main body having a front, a back, two sides, a head end, a bottom end, a head section, a body section, and a pocket attached to the sides of the head section and having a slit or opening extending laterally from side to side to receive the main body. Preferably a pocket flap of a rectangular piece of material is folded to form the pocket having the lateral slit that receives the main body after it has been rolled up and is ready for being transported or stored. The body section of the main body comprises mating zipper halves respectively attached substantially along the first and second sides of the body section. The mating zipper halves are positioned for engagement as parallel zippers when the bottom end is adjacent the lateral slit in the pocket.

To use the combination sleeping bag and mat of this embodiment, the pocket is folded under the back of the head section of the main body leaving a small cushioned area for the user's head. Alternatively, the pocket may be placed over the head of a mattress in the same manner as a fitted bed sheet. A parent or other caregiver of the user places the user onto the front of the body section with the user's head on the small cushion area of the head section adjacent the head end. The caregiver then folds the body section of the sleeping bag substantially in two so that the bottom end is just below the user's head end and pulls the runner of each of the zippers to engage the respective mating zipper halves. The parallel side zippers permit the caregiver to place a sleeping infant or child on the sleeping bag/mat and to use the parallel zippers without disturbing the user. In addition, the parallel side zippers permit the user to be removed from the sleeping bag/mat by the caregiver pulling the runners on both sides up to the user's head and folding the body section back from the user's body without disturbing the user.

Another unique feature of the present invention is the sleeping mat configuration. The main body is initially placed with the front side up and the parallel side zippers in the unzipped position. The pocket is folded over the head section. The caregiver grasps each side of approximately the upper one-third of the main body's length and that approximately one-third portion is folded into the lateral slit of the pocket. The pocket is then filled with about one third of the sleeping bag and the sleeping bag with the filled pocket is turned onto its back to form the mat having a cushioned pillow for the user's head. A child or infant can be placed on the front of the mat of this invention without any interference from a zipper or other fastener. If the sleeping bag of U.S. Pat. No. 3,510,889 referred to under the Background of the Invention section were used as a mat, the lateral zipper attached to the bottom end of the front and back panel would run laterally from side to side approximately in the middle of the mat between the head and bottom ends. This would cause discomfort to the user lying on the mat.

In the preferred embodiment of the present invention another zipper half is attached to the back of the main body and extends laterally from side to side of the body section and a mating zipper half is attached to the inner edge of the pocket and extends laterally along the inner edge of the slit. This zipper is transverse to parallel zippers and permits the caregiver to mate the two transverse zipper halves after the main body has been rolled or folded up toward the head end and tucked through the slit into the pocket. After this zipper is closed, the sleeping bag is in a compact bag position that can easily be transported.

In another embodiment, a detachable shoulder strap can be easily clipped in place between the sides of resulting main body after the body section has been tucked into the pocket to form the compact bag. The resulting compact shoulder bag measures approximately 6 to 10 inches in diameter, weighs less than five (5) pounds and may be carried by a child.

BRIEF DESCRIPTION OF THE DRAWINGS

Further features and advantages will become apparent from the following and more particular description of the preferred embodiment of the invention, as illustrated in the accompanying drawings in which.

DETAILED DESCRIPTION OF THE INVENTION

Figure 1:
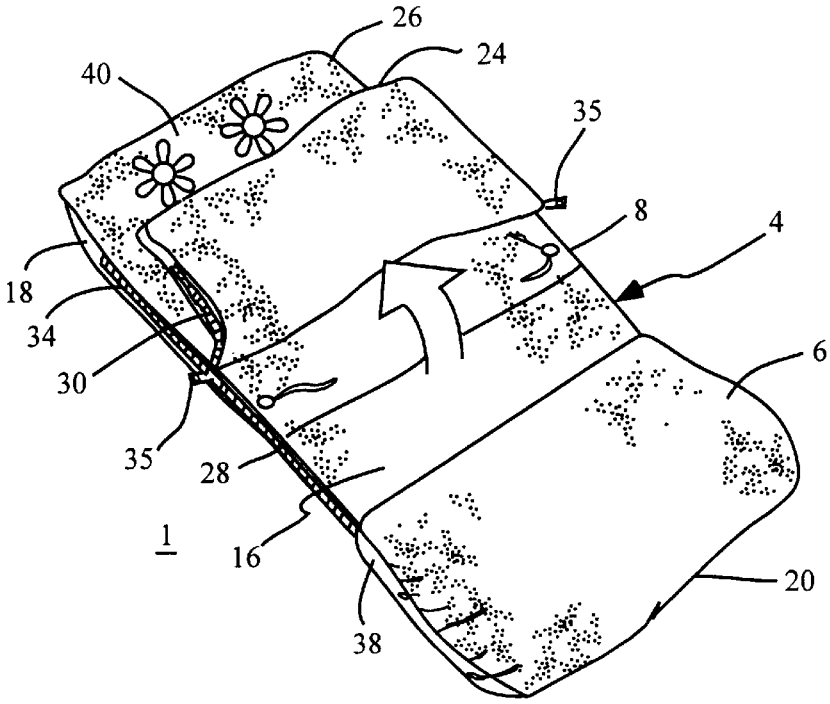
FIG. 1 is a front and right side perspective view of the sleeping bag constituting one embodiment of the present invention with the lower part of the body section of the main body and the bottom end folded back, and the pocket folded under the back of the head section.
Figure 2:
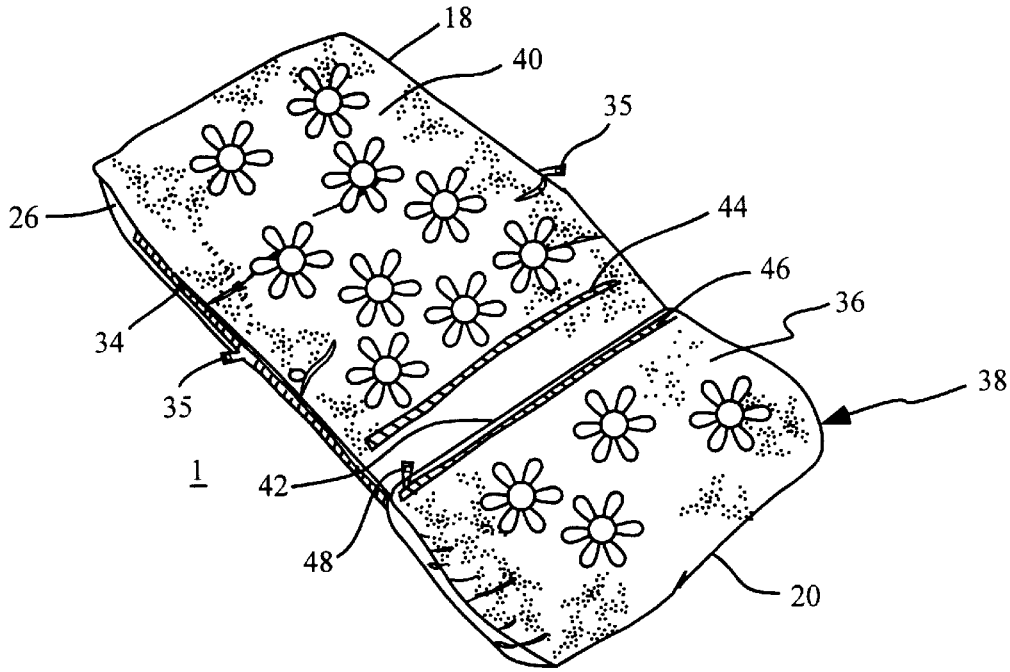
FIG. 2 is a back and left side perspective view of a sleeping bag shown in FIG. 1 to show the zipper halves of the transverse zipper.

FIGS. 1 and 2 are illustrative of a typical configuration of one embodiment of the present invention. In this embodiment, sleeping bag 1 includes main body or member 4 having head section 6, body section 8, front 16, right side 18, head end 20, bottom end 24, left side 26, and back 40. Parallel zipper half 28 is attached along right side 18 and left side 26 of one part of body section 8 and parallel zipper engaging half 30 is attached along right side 18 and left side 26 of along the other part of body section. After body section 8 is folded in two parts of substantially equal length, each parallel zipper half 28 is respectively in a position for engagement with parallel zipper engaging half 30 of parallel zippers 34 as shown in FIGS. 1 and 2. About half of the length of zippers 34 is shown in FIG. 1 engaged or mated by means of runner 35 attached to the engaging halves 30 and bottom end 24 is folded back. Engaging half 30 can be sewn along the right and left sides 18 and 26 either on the upper part of body section 8 toward head section 6 or on the lower part of body section 8 toward the bottom end 24 and zipper half 28 can be correspondingly sewn either on the lower part or upper part of body section 8. The exact placement of the engaging halves of the zippers with the runners is not critical so long as sleeping bag 1 has parallel zippers that are attached to each side of body portion 8 after it has been folded into two substantially equal parts.

Pocket flap 36 of pocket 38 is shown in FIG. 1 folded under back 40 of head section 6 of sleeping bag 1 to expose front 16 of the entire head section 6. Pocket 38 is described below in connection with storing and transporting sleeping bag 1.

The length of main body 4 is specifically designed to accommodate about twice the length of a child. Accordingly, the length of main body 4 is preferably designed to be approximately six (6) to eight (8) feet. The width of main body 4 is approximately 18 to 30 inches. When body section 8 is folded substantially in half, runners 35 are in a position for mating parallel zipper halves 28 with engaging halves 30 and the length of zipper 34 is about 30 to 40 inches. Head section 6 is approximately six (6) inches to eight (8) inches long to accommodate the child's head.

Pocket flap 36 preferably is sewn along right side 18 and left side 26 starting at a point on head section 6 adjacent zipper 34 and extends approximately 8 to 12 inches beyond head end 20 before being folded back onto itself. By sewing pocket flap 36 in this manner, rectangular pocket 38 is formed having lateral slit 42 extending from side to side to accommodated the width of main body 4. The dimensions of pocket 38 are not critical except to allow sufficient space to accommodate the width of main body 4 and the space occupied by a rolled up main body 4.

Main body 4 is filled with suitable batting or other filling material 5 to provide the necessary insulation so that its overall thickness is in the range of about ¾ to 1-½ inches. In some application, a suitable material is Thinsalite fabric. The batting preferably is sewn into sections of main body 4, e.g. with a cotton, nylon, or other suitable thread. Front 16, back 40 and pocket flap 36 of main body 4 consists of a suitable fabric that preferably is washable, e.g. cotton or a synthetic fabric.

Figure 4:
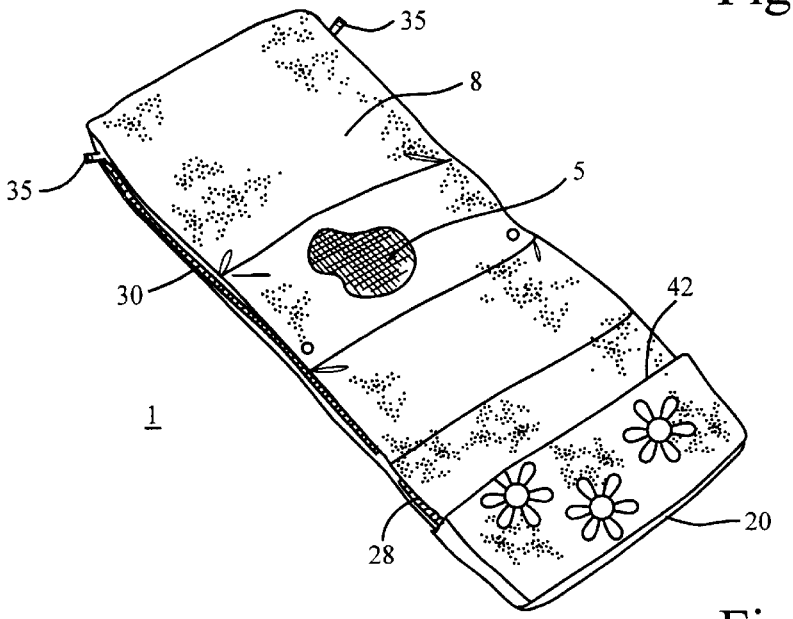
FIG. 4 is a front and right side perspective view of the sleeping bag shown in FIG. 1 with a portion of the main body being tucked into the pocket and a cut away section showing the main body filled with a suitable batting.

FIG. 2 shows zipper half 44 attached laterally across back 40 between right side 18 and left side 26 and engaging zipper half 46 attached laterally across pocket flap 36 from right side 18 to left side 26 adjacent slit 42 having runner 48. After pocket 38 is reversed, main body 4 is tucked into pocket 38, and then runner 48 is used to engage the two zipper halves of transverse zipper 50 (shown in FIGS. 6 and 7). FIG. 4 shows sleeping bag 1 after pocket 38 has been reversed, but before the main body 4 is completely tucked into pocket 38.

Figure 3:
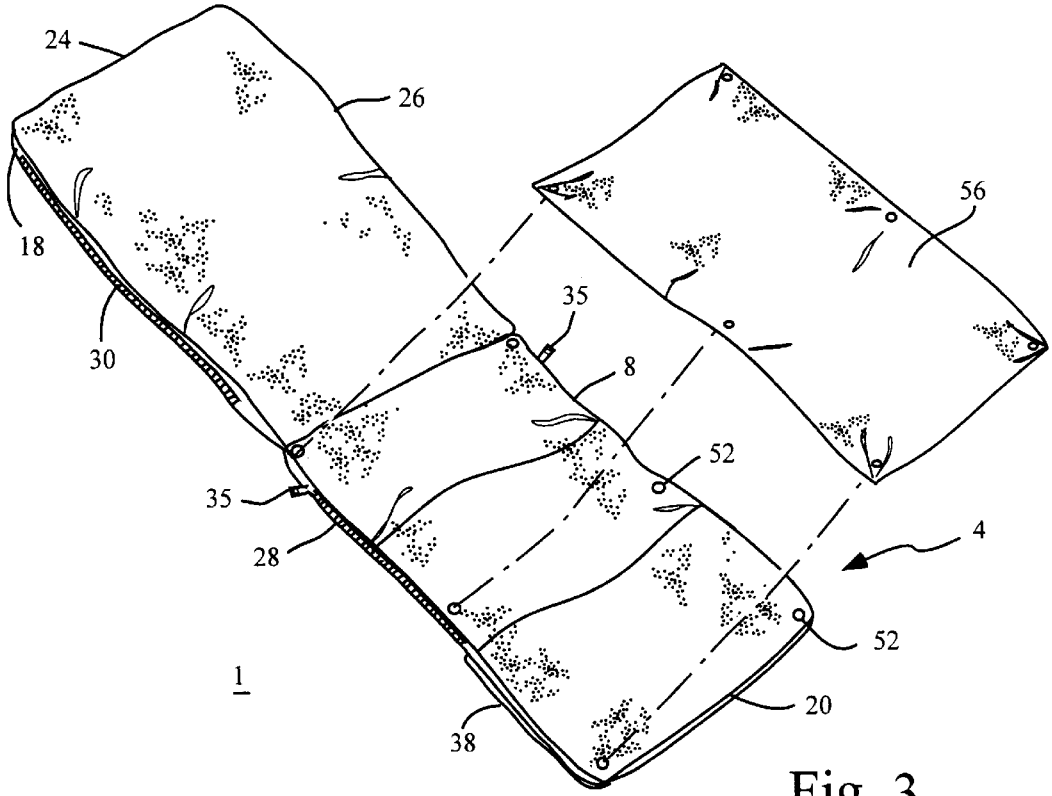
FIG. 3 is a front and right side perspective view of a sleeping bag constituting another embodiment of the present invention with a detached sheet being snapped or otherwise fastened to a portion of the front of the main body.

Sleeping bag 1 of FIGS. 1 and 2 is shown in FIG. 3 with snaps or other fasteners 52 to attach sheet 56 to front 16 of head section 6 and the upper portion of body section 8. Alternatively, sheet 56 can be removably attached to front 16 by means of Velcro® fasteners. Sheet 56 can be cotton or other absorbent material. Preferably sheet 56 consists of water resistant material such as a double layer of flannel to serve as protection 15 from perspiration or bed wetting of an infant or child. Rubberized cotton could be used in some cases.

Figure 5:
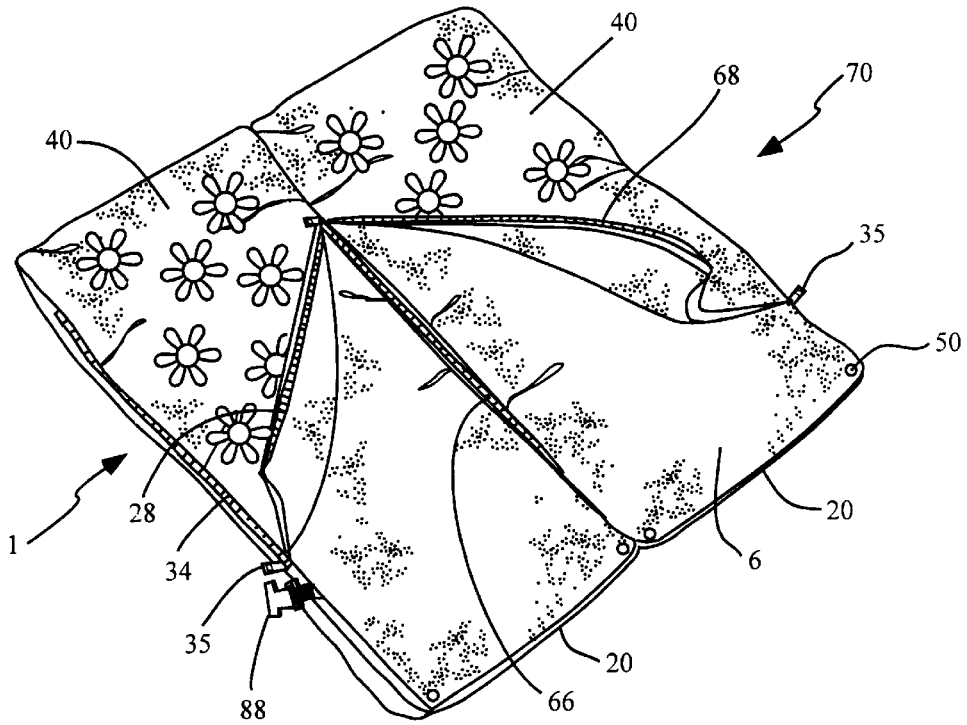
FIG. 5 is front and right side view of a double sleeping bag constituting still another embodiment of the present invention.

In the double sleeping bag configuration shown in FIG. 5, parallel zipper half 66 is convertibility engageable with both engaging half 28 on sleeping bag 1 and engaging half 68 sewn on left side of sleeping bag 70. All the remaining features of sleeping bags 1 and 70 are the same as described above.

Figure 6:
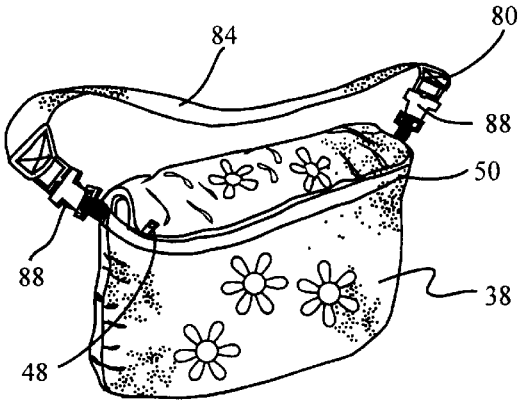
FIG. 6 is a perspective top, front and right side view of a compact shoulder bag constituting still another embodiment of the present invention with detachable shoulder straps after the body section of the sleeping bag of the type shown in FIGS. 1, 2 and 5 is tucked into the pocket and ready for being transported.
Figure 7:
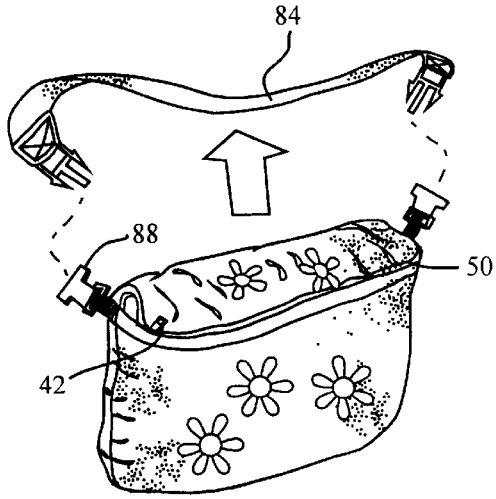
FIG. 7 is perspective front and right side view of compact shoulder bag shown in FIG. 6 with the shoulder straps being detached.

Compact shoulder bag 1 shown in FIGS. 6 and 7 is the result of main body 1 being tucked within slit 42 of pocket 38 and runner 48 engaging zipper halves 44 and 46 of transverse zipper 48. A pair of buckles or other fasteners 80 is attached to respective ends of shoulder strap 84. A pair of mating fasteners 88 is attached to each end of short strap 84 to provide shoulder strap 84 to be easily detached from sleeping bag 1. Preferably fasteners 80 and 88 are slide release buckle typically used on buoyancy control vests of scuba diving equipment and waist packs.

Figure 8:
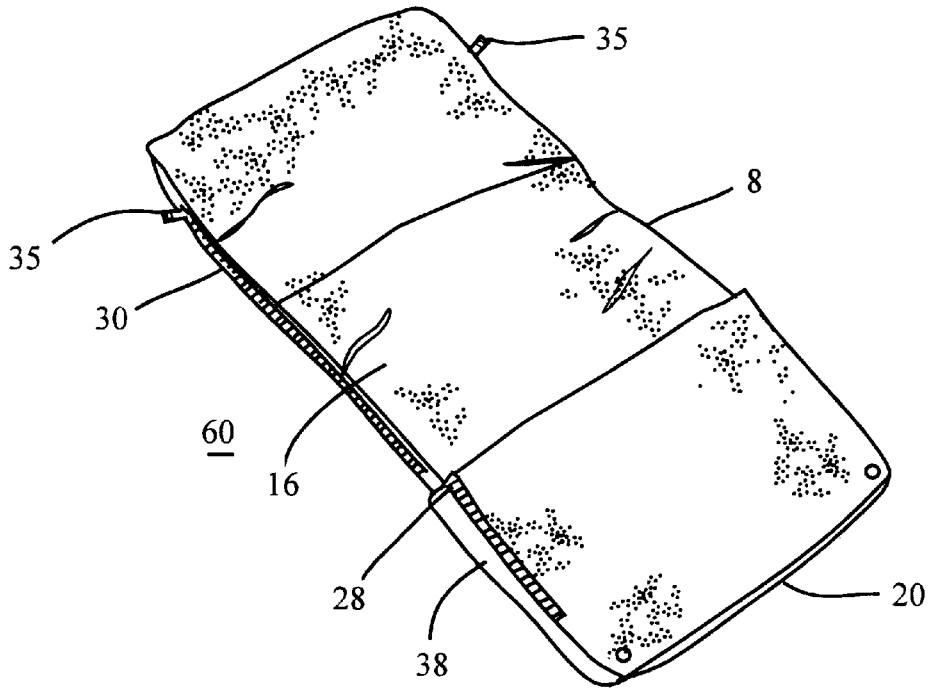
FIG. 8 is a front and right side perspective view of the sleeping bag shown in FIG. 1 in its sleeping mat configuration with about one third of the main body tucked into the pocket.

Referring now to FIG. 8, sleeping bag 1 is shown in its sleeping mat configuration with approximately a 12 to 14 inch length of main body 4 below head end 20 folded over onto a similar length of itself and the two lengths tucked into pocket 38. To place sleeping bag 1 into the sleeping mat configuration, bag 1 is reversed so that back 40 is exposed and the two lengths of main body 4 are folded into pocket 38, and then bag 1 having filled pocket 38 is turned over to expose front 16 as shown in FIG. 8. Mat 60 is approximately 36 to 40 inches long and has a pillow of about three (3) to six (6) inches thick at head section 6.

The following example further illustrates the preferred embodiment of the present invention. These examples are for illustrative purposes and are not meant to limit the scope of the claims in any way.

EXAMPLE

A sleeping bag shown in FIGS. 1–3 and having the slide release buckles 88 and shoulder straps 84 as shown in FIGS. 6–7 was made having the following finished dimensions: The overall length of sleeping bag 1 was 7 feet; the width was 27 inches; the thickness was approximately 1 inch; the depth of pocket 38 was 15 inches, the length of shoulder strap 84 was 32 inches; and sheet 56 was 26 inches wide by 47 inches long. Sleeping bag 1 had an exterior shell and an inner lining made of cotton flannel; and filled with a poly fiberfill. Sheet 56 was made of a double layer of cotton flannel. The hardware used for sleeping bag 1 was parallel separating zippers 34 having a length of 38 inches, and pocket-separating zipper 50 having a length of 26 inches; slide release buckles 88; and snaps 52.

Without departing from the spirit and scope of this invention, one of ordinary skill in the art can make various changes and modifications to the device of the present invention to adapt it to various usages and conditions. As such, these changes and modifications are properly, equitably, and intended to be, within the full range of equivalents of the following claims.

What is claimed is:

1. A combination sleeping bag and mat for infants and children comprising a main body having a front, a back, a first side, a second side, a head end, a bottom end, a head section, a body section, a pocket attached to the first and second sides of said head section and having a slit extending laterally from said first and second sides to receive said body section, said body section comprises mating zipper halves of a zipper respectively attached substantially along the first and second sides of said body section, said mating zipper halves are positioned for engagement as parallel zippers when said body section is folded and said bottom end is adjacent said slit during the sleeping bag configuration, whereas during the mat configuration the parallel side zippers are in the unzipped position, the pocket is folded over the head section, and a portion of the main body's length is folded into said slit of the pocket to form a cushioned pillow for the user's head such the user may be placed on the front of the resulting mat without any interference from a zipper or other fastener.

2. The device of claim 1, wherein a zipper half of a transverse zipper is attached to the back of said main body and extending laterally from said first and second sides and adjacent said head section, and an engaging half of said transverse zipper is attached to the inner edge of said pocket and extending laterally along said slit, said zipper half and said engaging half are positioned for engagement as said transverse zipper when said body section is tucked within said pocket.

3. The device of claim 2, wherein a shoulder strap is attached to said main body between said first and second sides for carrying said sleeping bag.

4. The device of claim 3, wherein first mating buckles are respectively attached to said first side and one end of said shoulder strap, and second mating buckles are respectively attached to said second side and the other end of said shoulder strap.

5. The device of claim 1, wherein a detachable sheet is attachable to said front of said main body.

6. The device of claim 1, wherein said main body is filled with a batting.

7. The device of claim 1, wherein said pocket is folded under the back of said head section when said sleeping bag is in use.

8. The device of claim 1, wherein said body section is folded in two parts of substantially the same length when said mating zipper halves are positioned for engagement.

9. The device of claim 1, wherein each of said parallel zippers is engagable with a mating zipper half attached on a side of a second sleeping bag to form a double sleeping bag.

10. The device of claim 1, wherein said pocket is filled with a portion of the main body to serve as a pillow for the sleeping bag in a sleeping mat configuration.

11. A combination sleeping bag and mat for infants and children comprising a main body having a front, a back, a first side, a second side, a head end, a bottom end, a head section, a body section, a pocket flap attached to at least a portion of the first and second sides of said head section to form a pocket having a slit extending laterally from the first and second sides to receive said body section of said main body, said body section comprises a zipper half and an engaging half of a zipper respectively attached substantially along the first and second sides of said body section, said zipper half and said engaging half are positioned for engagement as parallel zippers when said bottom end is adjacent said slit and said body section is folded in two parts of substantially the same length during the sleeping bag configuration, a mating zipper half of a transverse zipper attached to the back of said main body and extending laterally from said first and second sides and the other mating zipper half of said transverse zipper attached to the inner edge of said pocket flap and extending laterally along said slit, said mating zipper halves are positioned for engagement as said transverse zipper when said main body is tucked within said pocket to form a compact transportable bag, during the mat configuration the parallel side zippers are in the unzipped position, the pocket is folded over the head section, and a portion of the main body's length is folded into said slit of the pocket to form a cushioned pillow for the user's head such the user may be placed on the front of the resulting mat without any interference from a zipper or other fastener.

12. The device of claim 11, wherein a shoulder strap is attached to main body between said first and sides for carrying said compact transportable bag.

13. The device of claim 12, wherein first mating buckles are respectively attached to said first side and one end of said shoulder strap, and second mating buckles are respectively attached to said second side and the other end of said shoulder strap.

14. The device of claim 11, wherein a detachable sheet is attached to the front of said main body to cover said head section and at least the upper portion of said body section.

15. The device of claim 11, wherein said main body is filled with a batting.

16. The device of claim 11, wherein said pocket flap is folded under the back of said head section when said sleeping bag is in use.

17. The device of claim 11, wherein said pocket is filled with a portion of the main body to serve as a pillow for the sleeping bag in a sleeping mat configuration.

* * * * *